US011363863B2

(12) United States Patent
Servideo

(10) Patent No.: US 11,363,863 B2
(45) Date of Patent: Jun. 21, 2022

(54) SOFT TERRAIN WALKING ASSIST DEVICE

(71) Applicant: Ali Burkett Servideo, The Plains, VA (US)

(72) Inventor: Ali Burkett Servideo, The Plains, VA (US)

( * ) Notice: Subject to any disclaimer, the term of this patent is extended or adjusted under 35 U.S.C. 154(b) by 0 days.

(21) Appl. No.: 17/247,720

(22) Filed: Dec. 21, 2020

(65) Prior Publication Data

US 2021/0186168 A1 Jun. 24, 2021

Related U.S. Application Data

(60) Provisional application No. 62/951,442, filed on Dec. 20, 2019.

(51) Int. Cl.

| | |
|---|---|
| ***A45B 9/04*** | (2006.01) |
| ***A61H 3/02*** | (2006.01) |
| ***A45B 9/02*** | (2006.01) |
| *A45B 9/00* | (2006.01) |

(52) U.S. Cl.

CPC ..... *A45B 9/04* (2013.01); *A61H 3/0288* (2013.01); *A45B 9/02* (2013.01); *A45B 2009/005* (2013.01); *A45B 2200/05* (2013.01)

(58) Field of Classification Search

CPC ..... A45B 9/04; A45B 220/055; A61H 3/0288
See application file for complete search history.

(56) References Cited

U.S. PATENT DOCUMENTS

| | | | | |
|---|---|---|---|---|
| 1,031,247 A * | 7/1912 | Conrad | ..... | A61H 3/0288 135/80 |
| 1,863,457 A | 6/1932 | Stevens | | |
| 2,230,406 A * | 2/1941 | Johnson | ..... | A61H 3/0288 135/77 |
| 2,703,094 A * | 3/1955 | Speck | ..... | A61H 3/0288 135/80 |
| 2,799,287 A | 7/1957 | Wagner | | |
| 3,301,268 A | 1/1967 | Tryon | | |
| 3,310,340 A | 3/1967 | Brewer | | |

(Continued)

FOREIGN PATENT DOCUMENTS

| | | | | |
|---|---|---|---|---|
| DE | 3300280 A1 * | 7/1983 | ..... | A61H 3/0288 |
| DE | 4108834 A1 * | 9/1992 | ..... | A45B 9/04 |

(Continued)

*Primary Examiner* — David R Dunn
*Assistant Examiner* — Danielle Jackson
(74) *Attorney, Agent, or Firm* — Dunlap Bennett & Ludwig, PLLC; Brendan E. Squire

(57) ABSTRACT

A soft terrain walking assist device and foot for the same is disclosed. The walking assist device includes an elongate shaft having a proximal end and a distal end. A handle is defined at the proximal end. A foot is attached to the distal end. The foot formed as a rounded plate having a coupling on a top surface of the rounded plate. A plurality of downwardly protruding tabs disposed in a spaced apart relation about a peripheral edge of the rounded plate. The tabs are configured to penetrate a soft terrain in a ground surface and contain a portion of the soft terrain within a containment area defined between the bottom surface and an inner face of each of the plurality of downwardly protruding tabs. The present invention allows users with a stability or strength impediment to enjoy peaceful walks on the beach while providing added stability.

4 Claims, 4 Drawing Sheets

(56) References Cited

U.S. PATENT DOCUMENTS

| | | | | | |
|---|---|---|---|---|---|
| 4,098,283 | A * | 7/1978 | Tritle, Jr. | A45B 9/04 | 135/77 |
| 4,411,284 | A * | 10/1983 | Opitz | A45B 9/04 | 135/81 |
| 4,510,957 | A | 4/1985 | Frank | | |
| 4,562,851 | A | 1/1986 | Frank | | |
| 4,708,154 | A * | 11/1987 | Edwards | A61H 3/0288 | 135/84 |
| 4,776,361 | A | 10/1988 | Staton | | |
| 4,899,771 | A | 2/1990 | Wilkinson | | |
| 5,307,828 | A | 5/1994 | Gardner et al. | | |
| 5,377,710 | A * | 1/1995 | Laser | A45B 9/04 | 135/66 |
| 5,713,382 | A | 2/1998 | Midcap | | |
| 6,164,306 | A | 12/2000 | Townsend | | |
| 6,527,001 | B1 | 3/2003 | Saldan et al. | | |
| 6,877,520 | B2 * | 4/2005 | Morris | A45B 9/04 | 135/77 |
| 7,360,547 | B2 | 4/2008 | Carlson | | |
| 7,503,337 | B1 | 3/2009 | Morgan et al. | | |
| 7,686,025 | B1 | 3/2010 | Dowling | | |
| 8,555,907 | B2 * | 10/2013 | Kutz | A61H 3/0288 | 135/77 |
| 8,678,021 | B2 | 3/2014 | Vasilatos et al. | | |
| 9,144,275 | B1 * | 9/2015 | Birnbaum | A61H 3/0288 | |
| 9,226,556 | B1 * | 1/2016 | Chien | A45B 9/04 | |
| 9,386,831 | B1 * | 7/2016 | Raihala | A61H 3/0288 | |
| 9,723,901 | B1 | 8/2017 | Ober et al. | | |
| 10,064,464 | B1 * | 9/2018 | Birnbaum | A61H 3/0288 | |
| 10,813,421 | B2 * | 10/2020 | Lee | A45B 9/04 | |
| 10,863,803 | B2 * | 12/2020 | Strum | A45B 9/04 | |
| 2014/0041700 | A1 * | 2/2014 | Wu | A45B 9/04 | 135/17 |
| 2015/0374082 | A1 * | 12/2015 | Austin | A61H 3/0288 | 135/77 |

FOREIGN PATENT DOCUMENTS

| | | | | |
|---|---|---|---|---|
| DE | 29917124 U1 * | 3/2000 | A61H 3/0288 | |
| GB | 2494906 A * | 3/2013 | A61H 3/0277 | |
| KR | 20130017052 A * | 2/2013 | | |
| KR | 20160003137 U * | 9/2016 | | |

* cited by examiner

SOFT TERRAIN WALKING ASSIST DEVICE

CROSS-REFERENCE TO RELATED APPLICATION

This application claims the benefit of priority of U.S. provisional application No. 62/951,442, filed Dec. 20, 2019, the contents of which are herein incorporated by reference.

BACKGROUND OF THE INVENTION

The present invention relates to stability and strength assist devices, and more particularly to canes and walkers.

Conventional canes and walkers have a narrow tip, or foot, that has a tendency to sink into soft terrain, such as sand, soft soils, water saturated soils, and snow, and the like, thereby reducing the stability of the walking assist device and possibly causing the user to fall. These conventional walking assist devices make it difficult for an individual with a stability or strength impediment to enjoy peaceful walks on the beach while providing added stability.

As can be seen, there is a need for an improved foot for a walking assist device that improves the stability of the device in soft terrain.

SUMMARY OF THE INVENTION

In one aspect of the present invention, a walking assist device is disclosed. The walking assist device includes an elongate rod having a proximal end and a distal end. A handle defined at the proximal end. A foot is attached to the distal end. The foot is formed as a rounded plate having a coupling on a top surface of the rounded plate for attachment to the distal end of the elongate rod. A plurality of downwardly protruding tabs are disposed in a spaced apart relation about a peripheral edge of the rounded plate.

In some embodiments, a plurality of spikes are disposed in a spaced apart relation about a bottom surface of the rounded plate.

In some embodiments, the coupling is configured to removably attach the foot to the distal end of the elongate rod. The coupling may be a threaded coupling for cooperative engagement with a plurality of threads defined at the distal end of the elongate rod. In other embodiments, the coupling is a flex coupling permitting the foot to pivot about a longitudinal axis of the elongate rod.

In some embodiments, the flex coupling includes an elastomeric cap attached to the distal end of the elongate rod. An annular groove is defined about a circumference of the elastomeric cap. An aperture is defined through the rounded plate. The aperture is dimensioned to be received within the annular groove to retain the plate to the walking device. The elastomeric cap may further include a lower end beneath the annular groove. A bottom face is substantially flat and orthogonal to the longitudinal axis of the elongate rod. The bottom face is substantially co-planar with a bottom end of the plurality of downwardly protruding tabs.

In other aspects of the invention, a foot for a walking assist device is disclosed. The foot includes a rounded plate having a top surface, a bottom surface, and a peripheral edge. A coupling is provided on a top surface of the rounded plate and is configured for attachment to a distal end of the walking assist device. A plurality of downwardly protruding tabs are disposed in a spaced apart relation about the peripheral edge and are configured to penetrate a soft soil in a ground surface and contain a portion of the soft soil within a containment area defined between the bottom surface and an inner face of each of the plurality of downwardly protruding tabs.

In some embodiments, a plurality of spikes are disposed in a spaced apart relation about a bottom surface of the rounded plate. The plurality of spikes are configured for penetrating the soft soil contained within the containment area.

In some embodiments, the coupling is a threaded coupling for cooperative engagement with a plurality of threads defined at the distal end of the walking assist device.

In other embodiments, the coupling is a flex coupling permitting the foot to pivot about a longitudinal axis of the walking assist device. The flex coupling may include an elastomeric cap configured to attach to the distal end of the walking assist device. An annular groove defined about a circumference of the elastomeric cap. An aperture is defined through the rounded plate. The aperture dimensioned to be captively engaged with the annular groove.

In yet other embodiments, the elastomeric cap further comprises a lower end beneath the annular groove. A bottom face is substantially flat and orthogonal to the longitudinal axis of the walking assist device. The bottom face is substantially co-planar with a bottom end of the plurality of downwardly protruding tabs.

These and other features, aspects and advantages of the present invention will become better understood with reference to the following drawings, description and claims.

DETAILED DESCRIPTION

Figure 1:
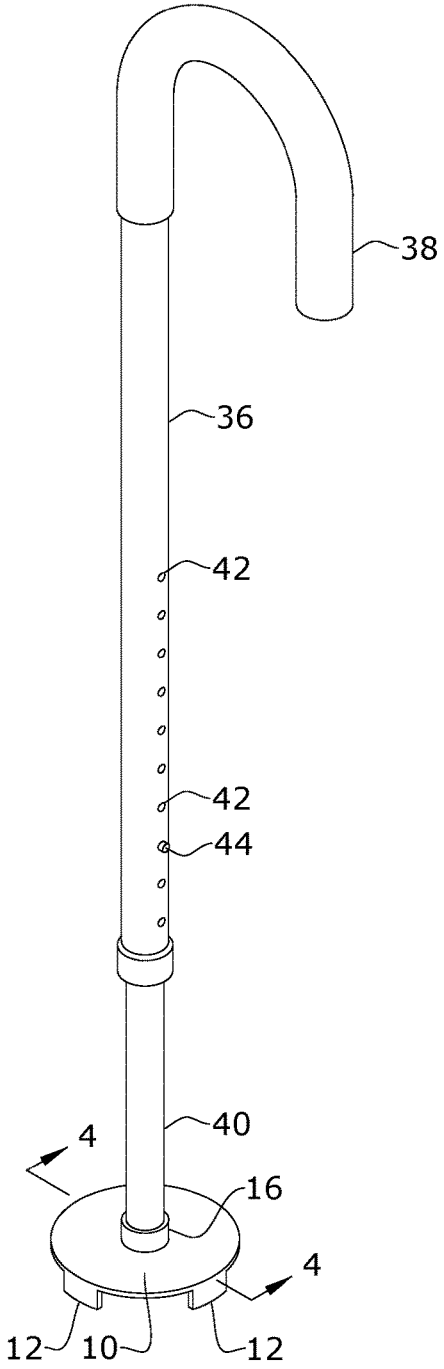
FIG. 1 is a perspective view of the invention, shown in-use.
Figure 2:
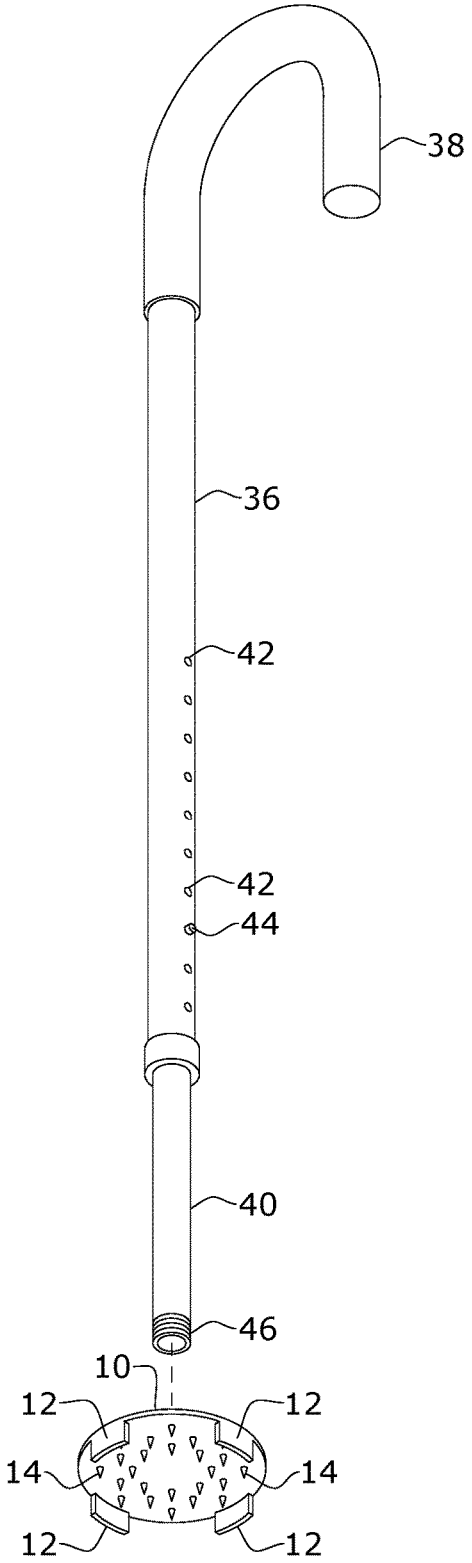
FIG. 2 is an exploded bottom perspective view of the invention.
Figure 3:
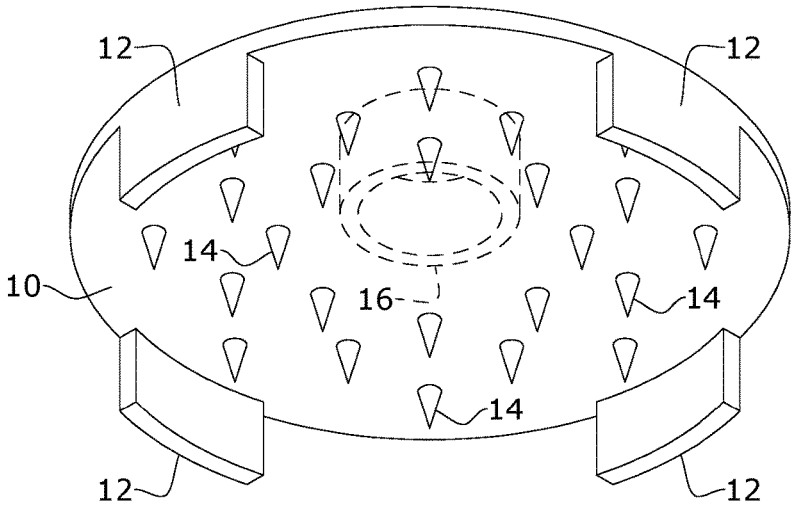
FIG. 3 is an enlarged bottom perspective detail view.
Figure 4:
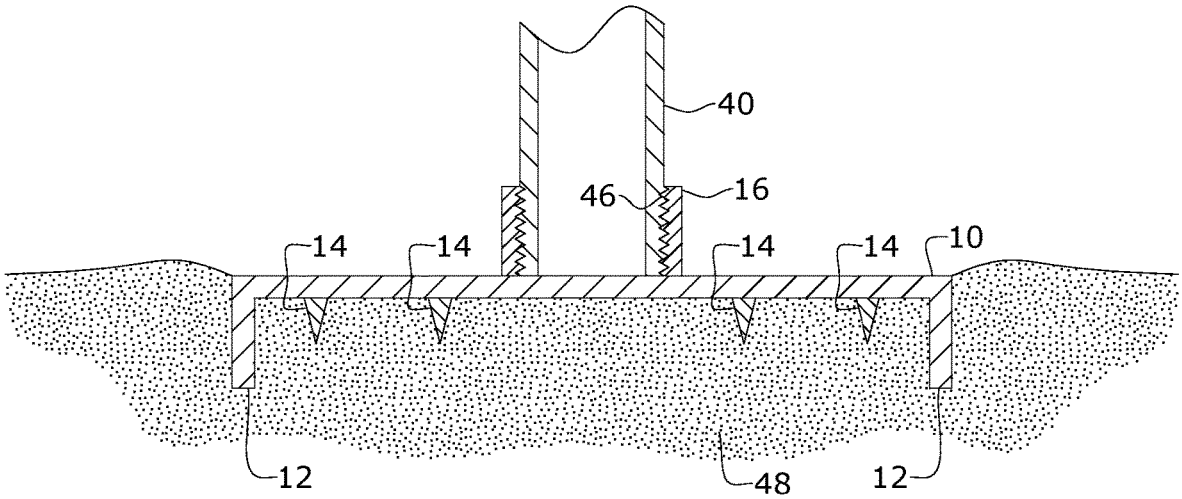
FIG. 4 is a section view taken along line 4-4 from FIG. 1.
Figure 5:
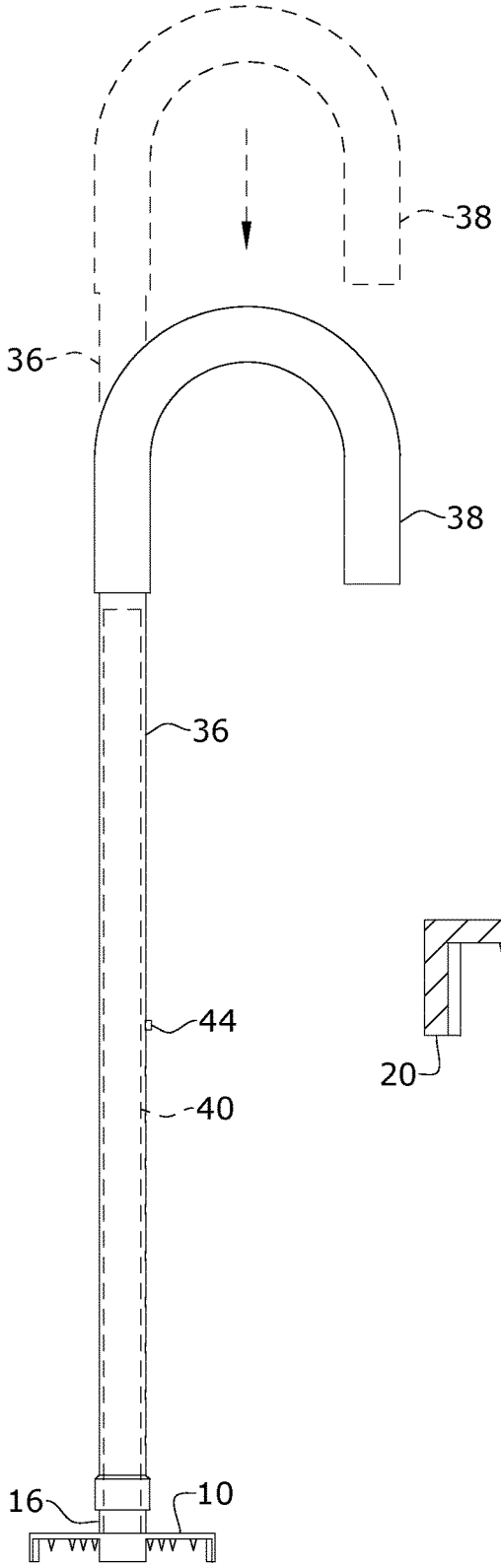
FIG. 5 is a front view of the invention, showing height adjustment.
Figure 6:
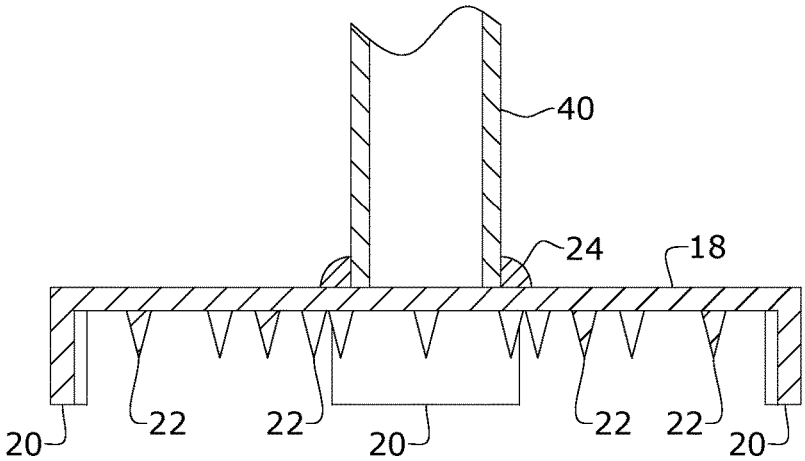
FIG. 6 is a section view shown with an alternate attachment.

The following detailed description is of the best currently contemplated modes of carrying out exemplary embodiments of the invention. The description is not to be taken in a limiting sense but is made merely for the purpose of illustrating the general principles of the invention.

Broadly, embodiments of the invention provide an improved support for a walking assist device when utilized in a soft condition of a supporting ground surface. The soft condition may include a sand, a saturated soil, a loose packed soil, and a snow covering of the supporting ground surface.

As seen in reference to the drawings of FIGS. 1-8, a walking assist device, such as a cane, includes an elongate rod having a proximal end 36 and a distal end 40. The elongate shaft may have an adjustable longitudinal length provided by telescopic cooperation of the proximal end 36 and the distal end 40. A plurality of apertures 42 are defined in one or more of the proximal end 36 and the distal end 40.

A pin 44 may be received through an aligned aperture of the plurality of apertures to adjust the length of the elongate shaft.

A handle 38 is defined at the proximal end 36 of the elongate shaft. The handle 38 is configured to be grasped by the user and support at least a portion of the user weight against a ground support surface, through the elongate shaft and a foot 10 coupled to the distal end 40 of the elongate shaft.

The foot 10 may be removably attached to the distal end 40. The foot 10 formed as a rounded plate having a coupling 16 on a top surface of the plate. A plurality of downwardly protruding tabs 12 are disposed in a spaced apart relation about a peripheral edge of the rounded plate. The plurality of downwardly protruding tabs 12 are configured to penetrate a soft soil in a supporting ground surface and contain a majority portion of the soft soil within a containment area defined between the bottom surface of the plate and an inner face of each of the plurality downwardly protruding tabs 12. A gap is defined between each of the plurality of downwardly protruding tabs 12 to permit a minority portion of the soft soil to pass between adjacent tabs 12. Preferably, the rounded plate is circular to provide stability in any of a fore, aft, or lateral direction, and combinations thereof.

In come configurations, a plurality of spikes 14 disposed in a spaced apart relation about a bottom surface of the plate. The plurality of spikes 14 are configured for penetration the soft soil contained within the containment area. The plurality of spikes 14 are configured to provide a frictional interface for engagement with uneven protrusions in the ground support surface. The plurality of spikes 14 may be formed by a perforation of the plate such as with a can opener, such that the plurality of spikes 14 have claw like curvature to improve gripping in the soft surface.

In some embodiments, the coupling 16 is configured to removably attach the foot to the distal end of the cane. In a non-limiting embodiment, the coupling 16 shown in reference to FIGS. 2-6, is a threaded coupling for cooperative engagement with a plurality of cooperating threads 46 defined at the distal end 40 of the elongate shaft.

Figure 7:
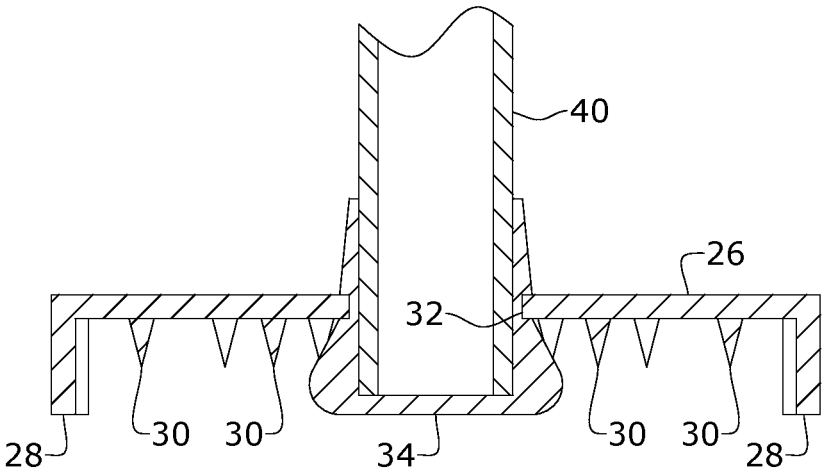
FIG. 7 is a section view shown with an alternate attachment.
Figure 8:
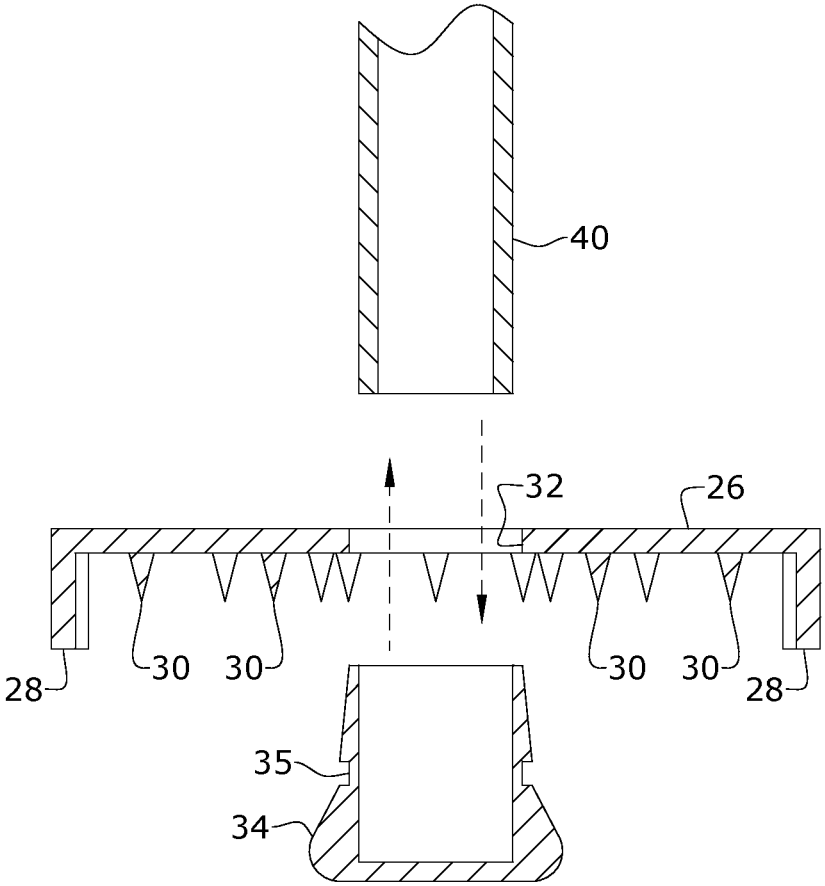
FIG. 8 is an exploded view of the alternate attachment.

Alternatively, the coupling 16 may be a flex coupling, such as shown in reference to FIGS. 7 and 8. In this non-limiting embodiment, the coupling is a flex coupling permits the foot to pivot about a longitudinal axis of the elongate shaft. The flex coupling may include an elastomeric cap 34 attached to the distal end 40 of the elongate shaft. An annular groove 35 defined about a circumference of the elastomeric cap 34. An aperture 32 defined through the plate. The aperture 32 is dimensioned to be received within the annular groove 35 to captively retain the plate on the elastomeric cap 34. The elastomeric cap 34 may have a variety of densities selected based on a desired stability or flexure of the foot 10 about the elongate shaft 40.

A lower end of the cap 34, beneath the annular groove 35 has a bottom face that is substantially flat and orthogonal to the longitudinal axis of the elongate shaft. The bottom face is positioned so that it is substantially co-planar with a bottom end of the plurality of downwardly protruding tabs 12. The bottom face may protrude beyond the co-planar alignment to provide a conventional support to the user when traversing paved or solid supporting ground surfaces.

It should be understood, of course, that the foregoing relates to exemplary embodiments of the invention and that modifications may be made without departing from the spirit and scope of the invention as set forth in the following claims.

What is claimed is:

1. A walking assist device, comprising:

an elongate shaft having a proximal end and a distal end;

a handle defined at the proximal end; and a foot attached to the distal end, the foot formed as a rounded plate having an aperture defined through a top surface of the rounded plate, and a plurality of downwardly protruding tabs disposed in a spaced apart relation about a peripheral edge of the rounded plate;

an elastomeric cap removably attached to the distal end of the elongate shaft, an annular groove defined about a circumference of the elastomeric cap, a lower end beneath the annular groove, a bottom face that is substantially flat and orthogonal to a longitudinal axis of the elongate shaft, and the bottom face is substantially co-planar with a bottom end of the plurality of downwardly protruding tabs, the aperture dimensioned to be removably coupled with the annular groove for pivoting the foot about the longitudinal axis of the elongate shaft.

2. The walking assist device of claim 1, further comprising:

a plurality of spikes disposed in a spaced apart relation about a bottom surface of the rounded plate.

3. A foot for a walking assist device, comprising:

a rounded plate having a top surface, a bottom surface, and a peripheral edge;

an aperture defined through the rounded plate, a plurality of downwardly protruding tabs disposed in a spaced apart relation about the peripheral edge and configured to penetrate a soft soil in a ground surface and contain a portion of the soft soil within a containment area defined between the bottom surface and an inner face of each of the plurality of downwardly protruding tabs; and a flex coupling formed as an elastomeric cap configured to attach to a distal end of the walking assist device, an annular groove defined about a circumference of the elastomeric cap, a lower end beneath the annular groove, a bottom face that is substantially flat and orthogonal to a longitudinal axis of the walking assist device, wherein the bottom face is substantially co-planar with a bottom end of the plurality of downwardly protruding tabs, the aperture dimensioned to be captively engaged with the annular groove, permitting the foot to pivot about the longitudinal axis of the walking assist device.

4. The foot of claim 3, further comprising:

a plurality of spikes disposed in a spaced apart relation about the bottom surface of the rounded plate, the plurality of spikes configured for penetrating the soft soil contained within the containment area.

* * * * *